United States Patent [19]

Orlando

[11] Patent Number: 4,860,777

[45] Date of Patent: Aug. 29, 1989

[54] COMBINATION BEACH BLANKET AND WIND PROTECTOR DEVICE

[76] Inventor: Anthony Orlando, 99 Mercy St., Providence, R.I. 02909

[21] Appl. No.: 157,257

[22] Filed: Feb. 16, 1988

[51] Int. Cl.[4] ..... E04H 15/00; E04H 15/20

[52] U.S. Cl. ..... 135/87; 135/902; 52/DIG. 13

[58] Field of Search ..... 135/87, 900, 901, 902; 52/DIG. 13

[56] References Cited

U.S. PATENT DOCUMENTS

| | | | |
|---|---|---|---|
| 2,010,472 | 8/1935 | Angel | 135/902 |
| 2,837,777 | 6/1958 | White | 135/901 |
| 2,841,159 | 7/1958 | Graham | 135/901 |
| 3,404,696 | 10/1968 | De Souza Filho | 135/902 |
| 3,780,479 | 12/1973 | Billarant | 52/DIG. 13 |

FOREIGN PATENT DOCUMENTS

| | | | |
|---|---|---|---|
| 667499 | 7/1963 | Canada | 135/87 |
| 58908 | 8/1941 | Denmark | 135/87 |
| 3123117 | 12/1982 | Fed. Rep. of Germany | 135/87 |
| 8397 | of 1904 | United Kingdom | 135/87 |

*Primary Examiner*—Henry E. Raduazo

*Attorney, Agent, or Firm*—Salter & Michaelson

[57] ABSTRACT

A combination beach blanket and wind protector device, including a flexible mat that is movable from a rolled-up, closed, carry position to a flat, open position, wherein the mat is disposed in a substantially horizontal position on a selected ground site, side and head panels being joined to the mat along fold lines thereof, and a plurality of openings being located in said mat in spaced relation adjacent to the side and head panels. A plurality of posts are provided, each of which extends through an opening in the mat for penetration into the ground for fixing the mat in the flat, open position thereon. A first fastening element is joined to the side and head panels, and a second fastening element is secured to the posts, wherein the first and second fastening elements cooperate for mounting the side and head panels on the posts, thereby locating the side and head panels in an upright position for sheltering an occupant who is lying on the mat.

5 Claims, 2 Drawing Sheets

COMBINATION BEACH BLANKET AND WIND PROTECTOR DEVICE

BACKGROUND OF THE INVENTION

The present invention relates to a combination beach blanket and wind protector and more particularly relates to a combination unit that is not only easily moved to a position of use but may be quickly disassembled for rolling up into a compact unit for carrying and/or storing.

Prior to the instant invention, some efforts have been made to provide a shield or similar construction that enables a person to lie in a horizontal position on the ground or on sand and be protected from wind. Quite frequently, winds at the beach, for example, are sufficiently strong enough to make sunbathing and resting very uncomfortable and therefore undesirable. Under such conditions, a sunbather would normally not be able to take advantage of sunbathing conditions even if the temperature were high enough, because of the high winds and the resulting movement of sand by the winds. Further, it is also desirable while sunbathing either on a ground area or at the beach to be somewhat insulated from other parties who might kick sand upon an unprotected occupant of a blanket or the like. It is also desirable to have available beach accessories, such as suntan lotion, first aid articles, and packaged food products, without having to search through bags and the like in which such articles are normally packaged or carried.

Applicant is aware of certain prior art patents that have been granted heretofore and show various attempts to solve the problems as experienced by sunbathers, set forth hereinabove; and the pertinent prior art of which applicant is aware are U.S. Pat. Nos. 1,930,404; 2,190,566; 2,208,458; 2,619,101; 2,675,807; 2,771,088; 2,981,256; 2,997,277; 3,976,113; 4,164,275; and 4,407,319.

As shown in the WAGNER U.S. Pat. No. 1,930,404, a simple strip of canvas is utilized for providing some form of protection for a person who would be sunbathing at a beach or the like wherein the cavas defines a stockade-type of construction that is secured in place by a plurality of stakes that are interconnected to the strip of canvas for the mounting thereof in an upright position. The JULIAN et al, U.S. Pat. No. 2,208,458, shows a similar device wherein a plurality of stakes locate a flexible wall construction in a vertical position the device further utilizing a hood as a protective member. The McGERRY et al, U.S. Pat. No. 2,619,101, also suggests the use of stakes for mounting panels in an upright position, and also includes a cover member as a sun shade. This patent further suggests the use of pockets as secured to vertical panels. The SCHWARTZ U.S. Pat. No. 2,997,277, suggests the use of a shelter wall that is mounted in a vertical position by posts, the shelter wall being secured on cylindrical articles that are fixed to the posts. The other patents also suggest the use of shelters or mats as used on the ground or sand, wherein an occupant lies on the mat or the like between erected walls for sunbathing.

As will be discussed hereinafter, the subject invention provides a unique and different form of a combination beach blanket and wind protector that enables the component parts of the device to be quickly assembled in the position of use and knocked down for rolling up to a carry or storage position with relative ease.

SUMMARY OF THE INVENTION

The combination beach blanket and wind protector device as embodied in the subject invention comprises a flexible mat that is movable from a rolled-up, closed, carry position to a flat, open position, wherein the mat is disposed in a substantially horizontal position on a selected ground site. Opposed and spaced side panels are joined to the mat along longitudinally extending fold lines, the side panels having a first fastening means joined thereto. A head panel is also joined to the mat, but along a laterally extending fold line, and a plurality of posts are provided that extend through the openings in the mat for penetration into the ground site for fixing the mat in the open position thereon. A second fastening means is located on said posts and cooperates with said first fastening means as joined to the side and head panels for securing said side and head panels to said posts for locating said side and head panels in an erected upright position for sheltering an occupant lying on said mat.

Accordingly, it is an object of the present invention to provide a combination beach blanket and wind protector device that includes a mat to which panels are joined and that have fastening means mounted thereon for securely locating the panels in an upright position on the posts.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE INVENTION

Figure 1:
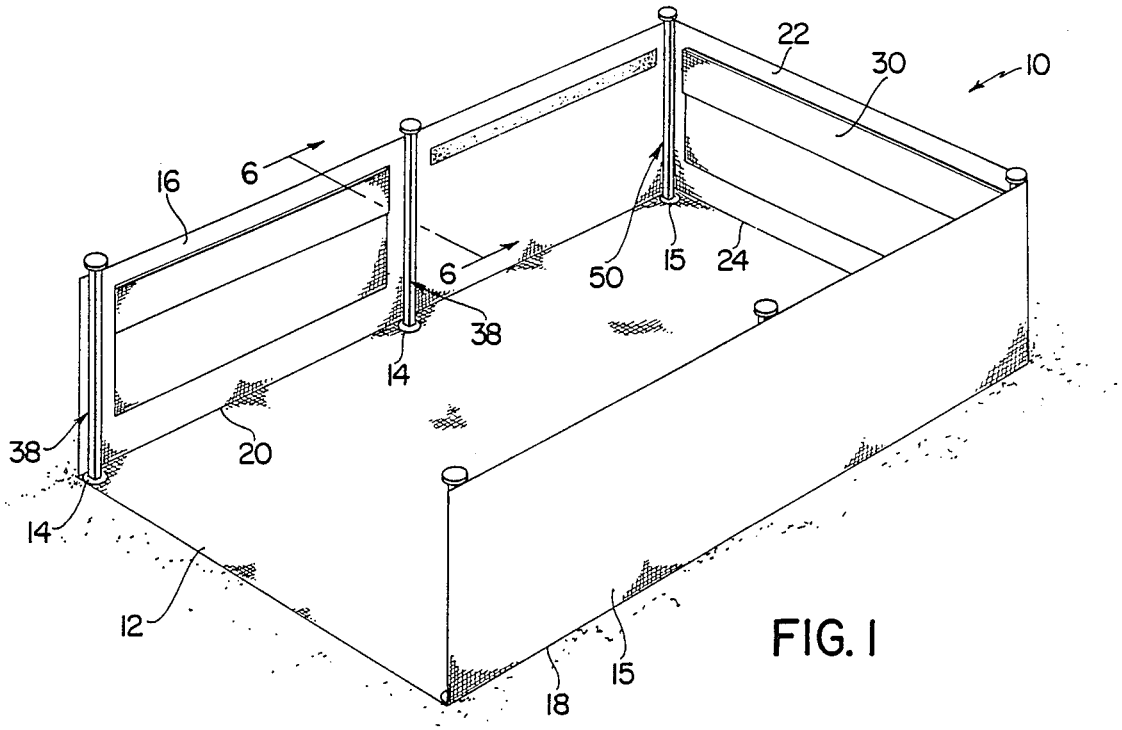
FIG. 1 is a perspective view of the combination beach blanket and wind protector device as embodied in the subject invention.

Referring now to the drawings, and particularly to FIG. 1, the combination beach blanket and wind protector device is illustrated and is generally indicated at 10. The combination device 10 is designed to be used in flat areas primarily and for providing a surface on which a user can lie for sunbathing, such as on a beach or on a ground area. As shown in FIG. 1, a flat, flexible mat 12 is provided in which a plurality of grommets 14 and 17 having appropriate holes are located adjacent relation to the perimeter areas of the mat. Side panels 15 and 16 are integrally joined to the mat 12 along longitudinally extending fold lines 18 and 20, respectively. A head panel 22 is also joined to the mat 12 along a laterally extending fold line 24, the panels 15, 16 and 22 defining an enclosure around three sides of the mat 12 for protecting an occupant lying on the mat 12 in a prone position.

Figure 2:
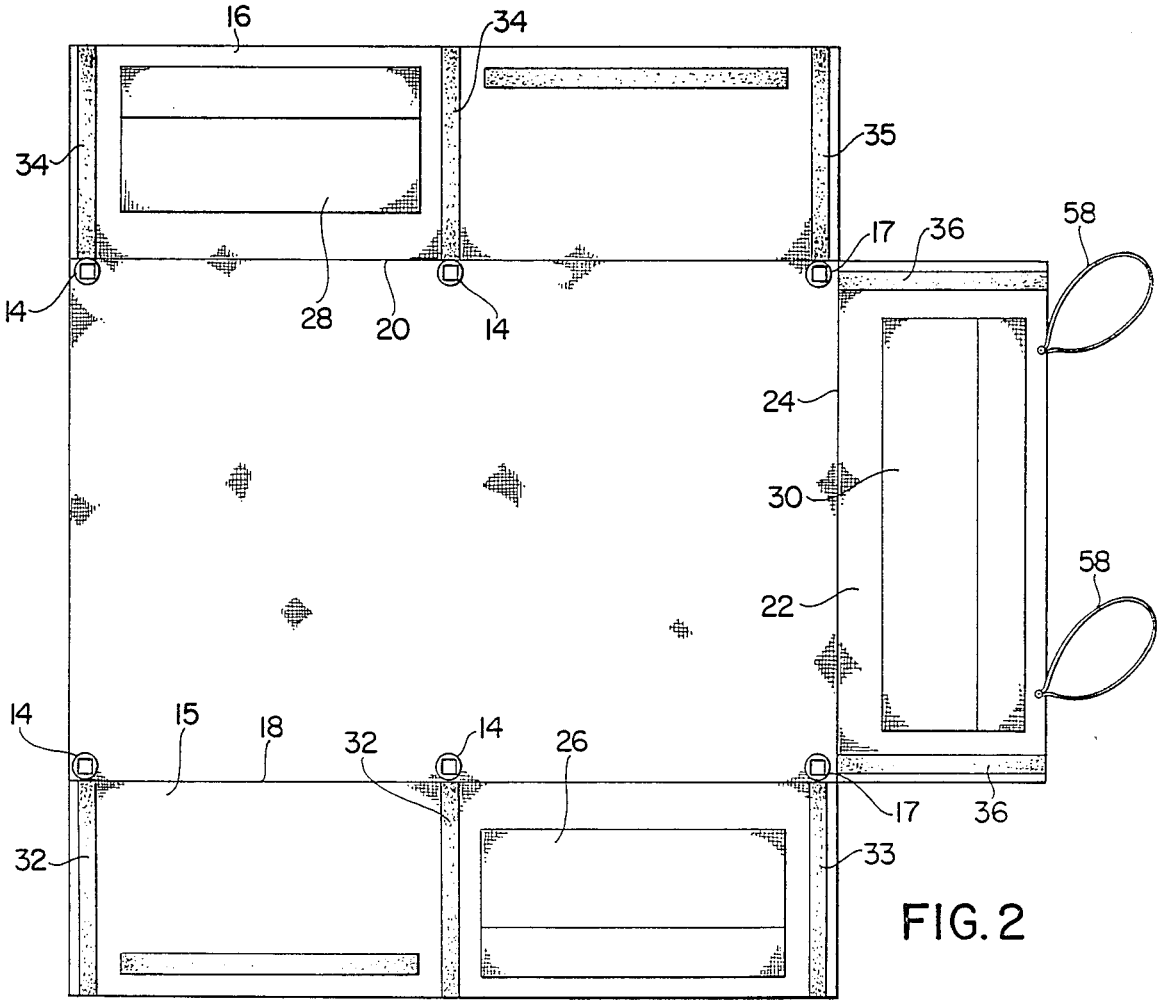
FIG. 2 is a top plan view thereof with the side and head panels of the device located in a flat position prior to the erection thereof to the vertical position.

As shown in FIG. 2, pockets 26, 28 and 30 are conveniently mounted on the panels 15, 16 and 22, respectively, and include conventional flaps for enclosing the pockets which can be used to retain accessories therein, such as suntan lotion, tubes or bottles, first aid articles and other articles that would be used by the occupant of the device and that would be immediately accessible while the occupant is located in the prone position on the mat 12 or in close proximity to the device. As further illustrated in FIG. 2, the panel 15 is provided with Velcro strips 32 and 33 that are disposed in spaced relation on the panel 14 and that are utilized in the erecting of panel 15 to the vertical position thereof, as will be described. Similarly, the panel 16 is provided with Velcro strips 34 and 35 that are disposed in spaced relation thereon and that are also utilized for erecting of the panel 16 to the vertical position thereof. As also shown in FIG. 2, Velcro strips 36 are secured in spaced relation to the head panel 22; and as described relative to the panels 15 and 16, the Velcro strips 36 are utilized for the purpose of mounting the panel 22 in an erected vertical position.

Figure 4:
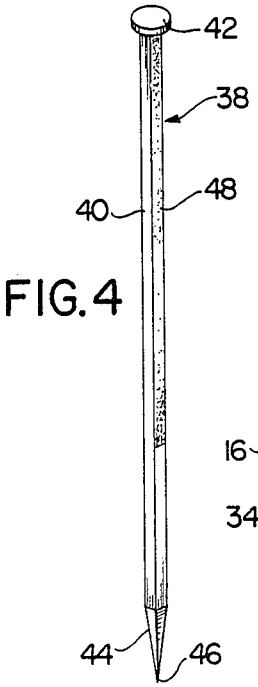
FIG. 4 is a perspective view of one of the posts as embodied in the subject invention and on which the side panels of the device are mounted.
Figure 6:
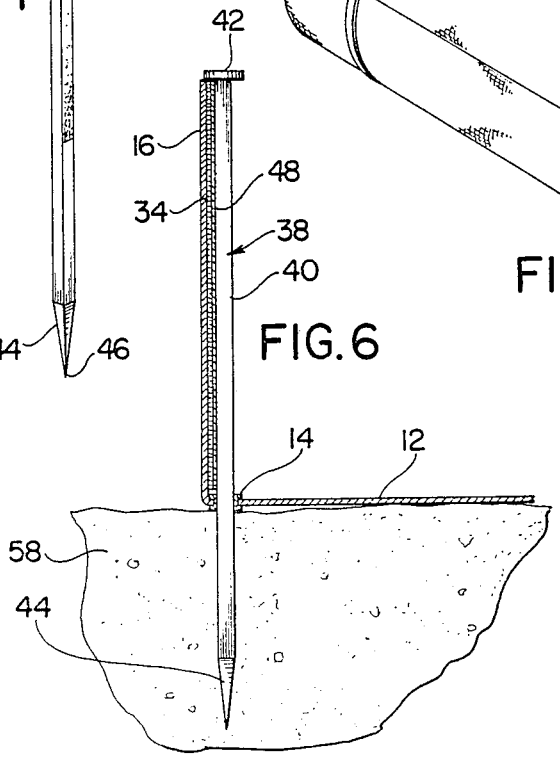
FIG. 6 is an elevational view of one of the posts as mounted in the ground and showing the manner in which a panel is mounted thereon.

In order to erect the side panels 15 and 16 in the vertical position thereof, a plurality of posts generally indicated at 38 in FIG. 4 are provided. Each of the posts 38 includes an elongated shaft 40 that terminates at its upper end in an enlarged head portion 42 and is formed at its lower end in a tapered section 44 that terminates in a point 46. The configuration of the shaft 40 is important for the securement of the side panels in the erected vertical position and is formed in a square, cross-sectional configuration. All of the posts 38 as employed in the subject invention are formed identically; although, as will be described, the posts that are employed at the head end of the mat 12 have a dual function of securing both the side panels 15 and 16 and the head panel 22 in place in the erected position thereof and, therefore, are especially adapted for this purpose. Referring again to FIG. 4, with further reference to FIG. 6, the shank 40 of the post 38 is shown including an elongated Velcro strip 48 that is provided with complimentary locking units that cooperate with the Velcro fasteners 34 and 36 to produce a locking action therewith. As shown in FIG. 6, the complimentary Velcro strip 48 is oriented in a manner that will receive a Velcro strip 34 in engagement therewith.

Figure 5:
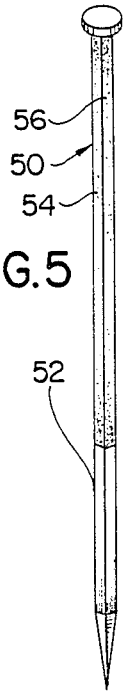
FIG. 5 is a perspective view of another post on which the head panel of the device is mounted.

Referring now to FIG. 5, a post generally indicated at 50 is illustrated and is utilized specifically for erecting the head panel 22 in the vertical position while simultaneously receiving the strips 33 and 35 of the side panels 15 and 16 in engagement therewith. The post 50 is provided with a shank 52 having a square cross-sectional configuration and receives a Velcro strip 54 on one face and a Velcro strip 56 on an adjacent face.

Figure 7:
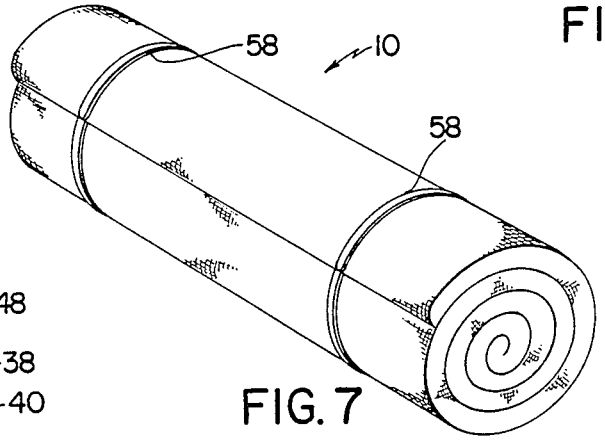
FIG. 7 is a perspective view showing the combination unit as located in the rolled-up storage or carry position.

In the assembly of the combination device 10, the device is moved from the rolled-up position as shown in FIG. 7 to a flat position as illustrated in FIG. 2. The posts 38 are inserted into the ground indicated at 50 through the openings as formed in the grommets 14. In the insertion of the posts 38 through the grommet openings, the Velcro strip 48 as it is attached to a face of the post 38 is oriented such that it faces outwardly of the mat 12, as illustrated in FIG. 6. The posts 50 which have the Velcro strips 54 and 56 applied to adjacent faces thereof are inserted into the openings of the corner grommets 15, the Velcro strip 54 facing outwardly toward the side panels 15 and 16, while the Velcro strips 56 face toward the head panel 22. Thereafter, the side panels 15 and 16 are folded along the fold lines 18 and 20 from the flat position to the erected vertical position as shown in FIG. 6, the Velcro strips 32 and 34 being secured to the corresponding interlocking strips 48 as attached to the posts 38. The Velcro strips 33 and 35 as secured to the side panels 15 and 16, respectively, are moved into engagement with the corresponding Velcro strips 54 as fixed to the posts 50. The head panel 22 is locked in the erected position by folding it along its fold line 24 for engagement of the Velcro strips 36 with the corresponding strips 56 as joined to the posts 50.

Figure 3:
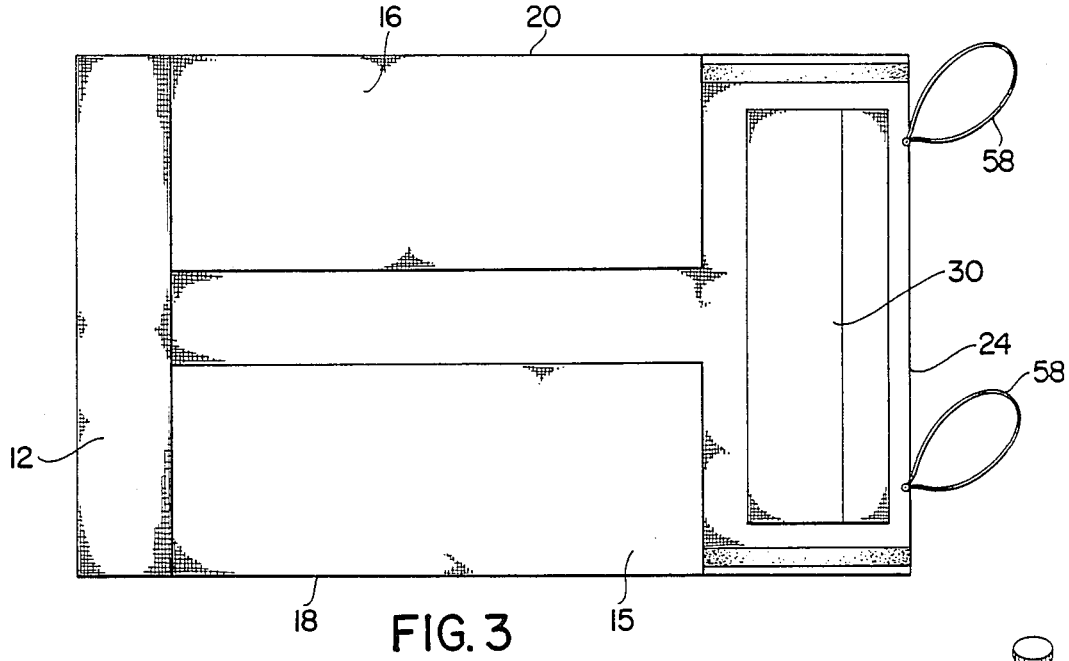
FIG. 3 is a top elevational view showing the side panels and head panel of the subject invention as moved to a position for the rolling of the unit to a rolled-up position.

It is understood that the side panels 15 and 16 or the head panel 22 may be removed from the erected vertical position selectively for location in a flat position as desired, and depending upon the conditions that are present at the time the device is used. The device is knocked-down from the erected position as illustrated in FIG. 1 by unfastening the side panels 15 and 16 and the head panel 22 and locating them in overlying relation on the mat 12 as illustrated in FIG. 3. Thereafter, the collapsed device is rolled up to the position shown in FIG. 7 and retained in the rolled-up position by moving flexible ties 58 to an encircling position around the rolled-up device as also illustrated in FIG. 7.

It is seen that the combination beach blanket and wind protector device is simple in construction and is easily set up to the erected position and held in place by the stakes 38 and 50. An occupant of the device has convenient access to the pockets 28 and 30 for storing beach accessory articles, and the device is easily and quickly moved to the erected position, and thereafter, as desired, knocked down for movement to the rolled-up position with relative ease.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A combination beach blanket and wind protector device, comprising a flexible mat that is movable from a rolled-up, closed, carry position to a flat, open position, wherein said mat is disposed in a substantially horizontal position on a selected ground site, opposed and spaced, flexible side panels joined to said mat along longitudinally extending fold lines, said side panels having a first Velcro-type fastening means joined thereto, and a flexible head panel joined to said mat at an end thereof along a laterally extending fold line, a plurality of openings formed in said mat in spaced relation adjacent to said side panels, and a plurality of posts, each of which extends through an opening for penetration into the ground for fixing said mat in the flat open position on said ground, and a second Velcro-type fastening means located on said posts and cooperating with said first fastening means joined to said side and head panels for securing said side panels to said posts for locating said side and head panels in an upright position for sheltering an occupant lying on said mat, said posts each comprising an elongated shank portion, a pointed tip portion at one end of the shank portion thereof and a head portion at the opposite end of the shank portion thereof, said posts comprising a first set thereof and a second set thereof, said first set of posts having said second fastening means secured to a first surface as formed on the shank portion thereof, each of said second set of posts including a first surface portion on the shank portion thereof and a second surface portion on the shank portion thereof that is located in perpendicular relation with respect to said first surface portion, said first and second surface portions meeting to define an outer corner of said second posts, said second set of posts having said second fastening means secured to said first and second surface portions as formed thereon, wherein said side panels are interlocked to said second fastening means located on said first surface portion of said second set of posts, and said head panel is interlocked to said second fastening means located on said second surface portion of said second sets of posts.

2. A combination device as claimed in claim 1, said first and second fastening means being formed of a Velcro-type strip material that enables said fastening means to extend along a portion of said side and head panels and said posts for positively securing said side and head panels to said posts when said first and second fastening means are moved into engagement with each other.

3. A combination device as claimed in claim 2, said second fastening means being located on said posts such that said strip material faces outwardly of said mat, wherein said first fastening means as joined to said side and head panels locates said posts interiorly of said side and head panels when said panels are erected in the upright position thereof.

4. A combination beach blanket and wind protector as claimed in claim 1, a plurality of article receiving pockets joined to said side and head panels and being located such that they are disposed interiorly of said panels when said panels are located in the upright position thereof.

5. A combination device as claimed in claim 1, tie members joined to said head panel, said panels being movable to a rolled-up position to define a roll, wherein said tie members are located in enveloping relation around said roll to retain the panels and mat in the rolled-up position thereof.

* * * * *